US007357375B2

(12) United States Patent
Hambric

(10) Patent No.: US 7,357,375 B2
(45) Date of Patent: Apr. 15, 2008

(54) DEPLOYMENT AND RECOVERY SYSTEM FOR SELF DEPLOYED MULTI-FUNCTION IMAGING SENSORS

(75) Inventor: Harry N. Hambric, Fredericksburg, VA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 221 days.

(21) Appl. No.: 11/170,479

(22) Filed: Jun. 30, 2005

(65) Prior Publication Data

US 2007/0029274 A1 Feb. 8, 2007

(51) Int. Cl.
*B66D 1/36* (2006.01)

(52) U.S. Cl. ..... 254/334

(58) Field of Classification Search ..... 254/324, 254/334

See application file for complete search history.

(56) References Cited

U.S. PATENT DOCUMENTS 4,151,983 A * 5/1979 Stock et al. ..... 294/66.2
4,324,195 A * 4/1982 Cunningham et al. ..... 114/312
4,883,184 A * 11/1989 Albus ..... 212/274
6,685,170 B1 * 2/2004 Gwynn ..... 254/325
6,830,114 B2 * 12/2004 Hammonds ..... 180/6.2
2004/0079560 A1 * 4/2004 Hammonds ..... 180/6.48
2005/0239563 A1 * 10/2005 Pondorfer et al. ..... 472/33

* cited by examiner

*Primary Examiner*—Emmanuel M Marcelo
(74) *Attorney, Agent, or Firm*—Andrew Romero; John Raubitschek

(57) ABSTRACT

The invention enables the routine remote deployment of multi-function sensors from unmanned air ground platforms, such that a special assembly containing one sensor can be mounted and operated by remote control. The invention includes a circular frame with attached legs to grip the sensor during transport and recovery. The legs are stabilized (locked open or shut) by means of a threaded metal band/wire being retracted by means of a gear assembly pulling the threaded band and removing all slack. The legs' rotating point (fulcrum) is located between the circular frame and the top of the leg. The metal band is located nearer to the bottom of the legs and when it (band) is tightened, the legs are squeezed together sufficiently enough to grip the sensor inside their perimeter.

5 Claims, 4 Drawing Sheets

DEPLOYMENT AND RECOVERY SYSTEM FOR SELF DEPLOYED MULTI-FUNCTION IMAGING SENSORS

GOVERNMENT INTEREST

The invention described herein may be manufactured, used, sold, imported, and/or licensed by or for the Government of the United States of America.

FIELD OF INTEREST

The invention relates to deployable remote sensors and more particularly to a system that recovers deployable remote sensors.

BACKGROUND OF THE INVENTION

The current and projected size of imaging and other media sensors allow the development of very small multi-function sensors able to detect, characterize and identify targets in their sector of protections. These sensor devices lend themselves to being deployed by hand, or from air or ground platforms. The fast moving Future Combat System of United States Military Forces requires that remote sensor systems be employed forward, to the sides and to the rear of US forces. Deployment of these sensors by unmanned aerial vehicles will optimize the mobility and lethality of US Forces at all echelons through near real time situational awareness. The present invention permits UAVs to deploy and recover remote sensors.

SUMMARY OF THE INVENTION

Accordingly, one object of the present invention is to enable the routine remote deployment of multi-function sensors from unmanned air ground platforms, such that a special assembly containing one sensor can be mounted and operated by remote control. This is accomplished by the invention which includes a circular frame with attached legs to grip the sensor during transport and recovery. The "legs" are stabilized (locked open or shut) by means of a threaded metal band/wire being retracted by means of a gear assembly pulling the threaded band and removing all slack. The legs' rotating point (fulcrum) is located between the circular frame and the top of the leg. The metal band is located nearer to the bottom of the legs and when it (band) is tightened, the legs are squeezed together sufficiently enough to grip anything inside their perimeter.

BRIEF DESCRIPTION OF THE DRAWINGS

These and other objects of the invention will become readily apparent in light of the Detailed Description Of The Invention and the attached drawings wherein:

FIG. 3*a* is a detail of FIG. 3*b* and is a cut away side view showing the gear relation of the control assembly.

DETAILED DESCRIPTION OF THE INVENTION

Normally, remotely deployed, multi-function sensors (hereafter called the "sensor") are comprised of a cylindrical case with flat bottom and top. One side (the top side) is configured in a manner to allow an arm to be stowed inside the cylinder such that it does not protrude above the plane of the top surface.

Figure 1C:
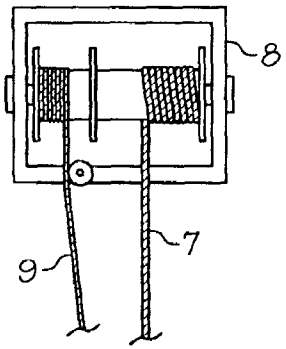
FIGS. 1*b* and 1*c* are side views of the camera gimbal which is a part of the invention and the winch assembly, respectively.
Figure 1B:
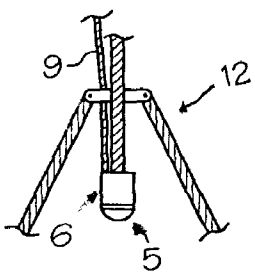
Figure 1A:
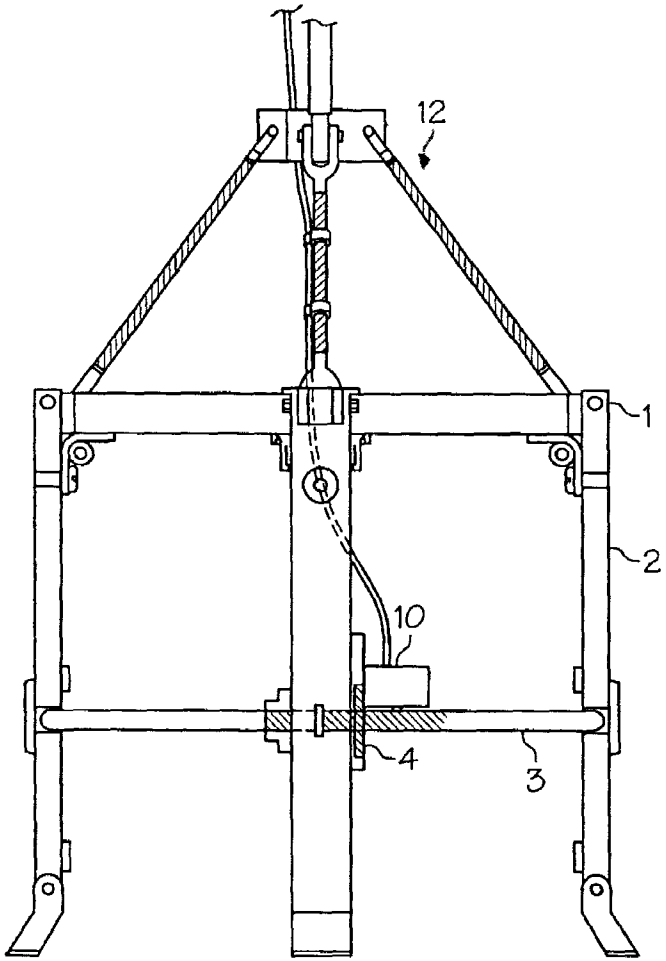
FIG. 1*a* is a side view of the invention.

As shown in FIG. 1*a*, the deployment and recovery apparatus of the present invention is comprised of a circular frame 1 with attached legs 2 to grip the sensor (not shown) during transport and recovery. The sensor can then be transported in circular frame 1 in a manner that enables it to be positioned and released from the circular frame 1 at the command of the delivery system platform operator.

The legs 2 are stabilized (locked open or shut) by means of a threaded metal band/wire 3 being retracted by means of a gear assembly 4 pulling the threaded band 3 and removing all slack. The legs' rotating point (fulcrum) is located between the circular frame and the top of the leg 2. The metal band 3 is located nearer to the bottom of the legs 2 and when it (band) is tightened, the legs 2 are squeezed together sufficiently enough to grip the deployed sensor inside their perimeter.

As shown in FIGS. 1*b* and 1*c*, the circular frame 1 is lowered and raised via a lift cable 7 and winch assembly 8 which also controls power cable 9 for a video camera 5 in a camera gimbal 6 and the winch motor 10. A basket sling assembly 12 (FIG. 1*c*) holds the circular frame 1 and connects it to the lift cable 7.

Figure 2:
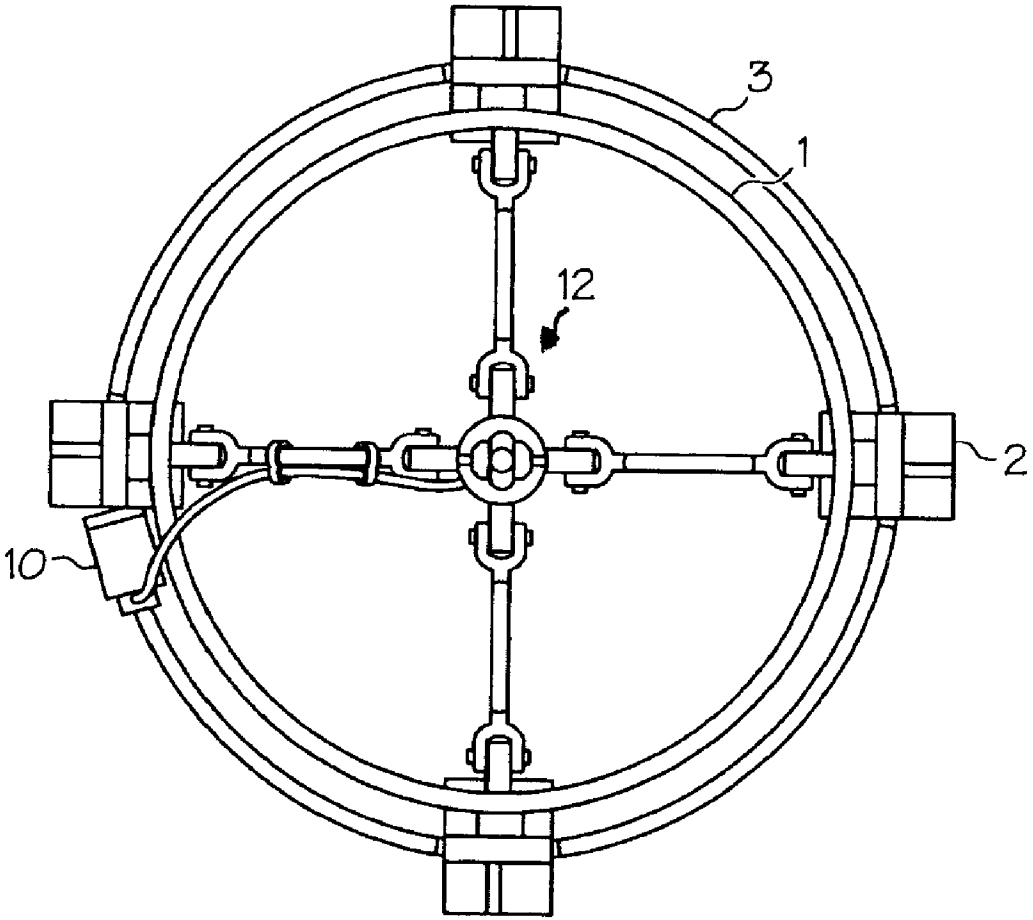
FIG. 2 is a top view of the invention.

FIG. 2 shows a top view of the present invention with the threaded band 3 extended so that it can receive a sensor. The basket sling assembly 12 holds the circular frame 1 and the motor 10 is mounted on the threaded band 3.

With a rotary winged unattended aerial vehicle (UAV) in the air, the delivery/recovery circular frame 1 can be guided to the precise location using the UAV's guidance system. Upon arrival the empty circular frame 1 is precisely guided (lowered) over the sensor to be recovered utilizing the video camera 5 in the camera gimbal 6 affixed to the top of the basket sling assembly 12. The operator positions the UAV over the sensor and lowers the circular frame 1 over the sensor to be recovered. The operator then operates the winch motor 10 of the invention to begin taking in the threaded metal band's 3 slack until the camera 5 confirms the sensor is firmly in the grasp of the legs 2. When the sensor is secured in the circular frame 1, the operator sends the winch motor 10 a signal to begin retrieval. The winch motor 10 will continue to operate until the circular frame 1 activates a cut-off switch ending the retrieval. The UAV then is directed to return' to its base, or to another mission waypoint where it will re-deploy the sensor for a new mission.

Figure 3B:
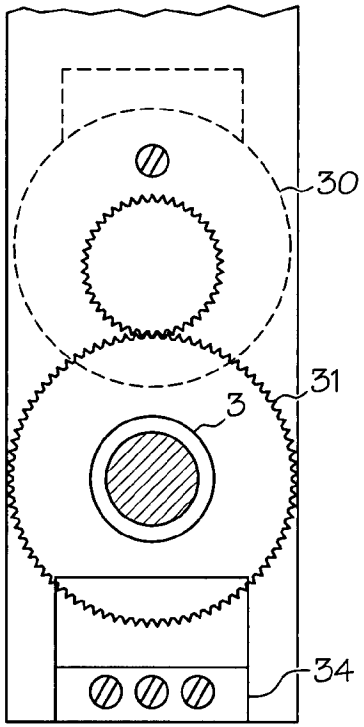
FIGS. 3*a* and 3*b* are cross sections of cable/band control assembly of the invention.
Figure 3A:
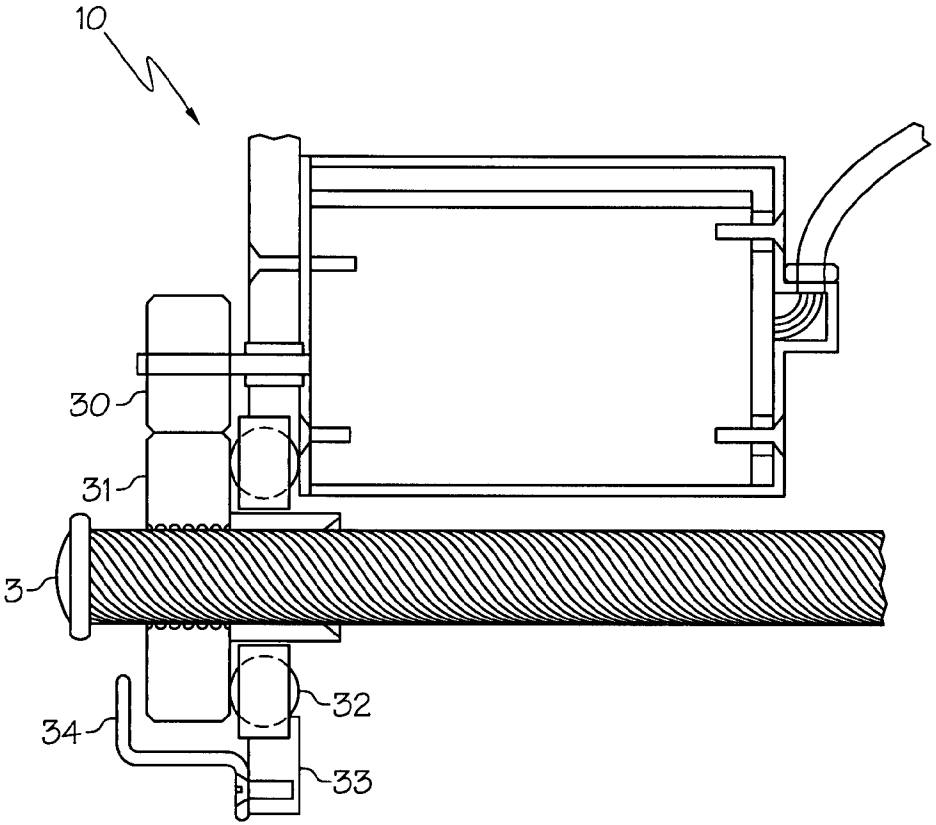

FIGS. 3*a* and 3*b* are cross sections of cable/band control assembly of the invention. FIG. 3*a* is a detail of FIG. 3*b* and is a cut away side view showing the gear relation of the control assembly. As shown, the gearing on the motor 10 has a first and secondary gear 30 and 31. Switch 32 is the cut off when the threaded band 3 is wound to a preselected tightness. Gear protector 34 is used to prevent slippage of the gears.

Figure 4:
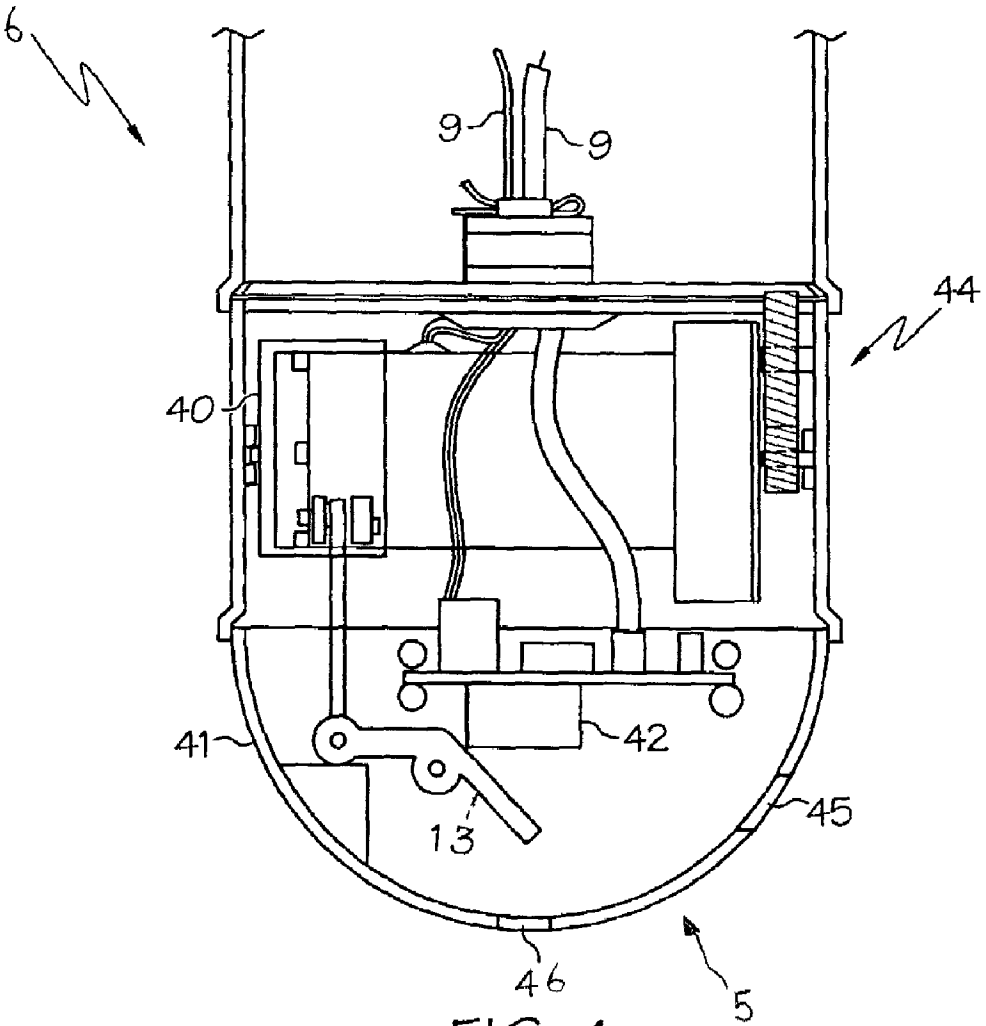
FIG. 4 is cross section of the gimbal assembly of the invention.

For deployment mission, the sensor is manually placed in the circular frame 1 prior to the UAV motor being started. In this case, unless the carrier UAV has landing gear sufficiently high enough to allow the circular frame 1 with sensor to fit beneath it, the winch 8 is unwound sufficiently to allow the circular frame 1 to lie on its side next to the UAV. The motor 10 is then activated to release steel banding 3 sufficiently to allow the sensor to be placed in the circular frame 1. The motor 10 is then reversed to tighten the steel strap around the sensor. The UAV is flown to the mission's location using its on-board guidance system. At the proposed mission site the UAV's belly camera is activated and the area searched for a suitable sensor location. When a potential position is located, the circular frame 1 is lowered to the ground. When the circular frame 1 carrying the sensor contacts the ground a switch on the legs 2 is opened, which stops the winch motor 10 and activates a control in the camera gimbal 6 to cause a mirror 13 in the camera gimbal 6 to position itself at a 45-degree angle in front of the camera lens. At the same time, the gimbal begins rotating continuously. The video signal from the camera 5 is displayed on the operator's console and allows the operator to evaluate the sensor performance from the proposed position. As shown in FIG. 4, the camera gimbal 6 itself has a motor 40 to turn the mirror 13 so that the imaging sensor 42 can show either the 45° position out of dome 41 through window 45 or show straight down through window 46 the rigging on to the circular frame 1. Mounting 44 is necessary to protect the motor. Both the motor 40 and the imaging sensor 42 are powered by power cable 9.

If the site is not suitable, the UAV operator can retrieve the circular frame 1. Beginning retrieval automatically resets all system functions and positions to allow for the next deployment insertion. The deployment begins anew.

If the site is suitable for deploying the sensor, the operator activates the motor release and the sensor is released from the legs 2. When the legs 2 are released, the motor 10 continues to operate until the circular frame 1 is fully extended for a recovery mission and is terminated by a switch sensing the band 3 is fully released. This same switch operation causes the camera mirror 13 to retract so the camera 5 is once again looking vertically down onto the sensor. The winch 8 is activated to pull the circular frame 1 away from the sensor and stops a short distance from it so the operator can observe the sensor reconfigure itself into its mission posture.

When the sensor has completed deployment it will automatically begin scanning due to the noise of the UAV above. If the sensor operation is successful, the operator then retrieves the circular frame 1 fully and the UAV proceeds to its next task. If not, the UAV will recover the sensor and return it to the UAV operator location for evaluation. Recovery is previously described above.

What is claimed is:

1. A deployment and recovery system for self deployed sensors comprising:

a winch means;

a rigging means connected to the winch means to raise or lower the rigging means;

a circular frame connected to the rigging means;

a set of legs attached to the circular frame;

a constrictable band attached around the legs;

means to constrict the constrictable band; and a camera to monitor the system attached to the rigging means.

2. The system of claim 1 wherein the constrictable band is a threaded band.

3. The system of claim 2 wherein the means to constrict the constrictable band is a motor attached to a set of gears configured to the threads of the threaded band.

4. The system of claim 1 wherein legs are capable of holding a sensor by constricting the constrictable band.

5. The system of claim 1 wherein the camera is comprised of a imaging sensor and a turnable mirror so that an image received by the imaging sensor varies and wherein an operator can monitor whether a sensor is deployed or recovered properly.

* * * * *